US011131004B2

(12) United States Patent
Thevenet et al.

(10) Patent No.: US 11,131,004 B2
(45) Date of Patent: Sep. 28, 2021

(54) DEVICE AND METHOD FOR CARRYING OUT CONTROLLED OXIDATION OF METAL STRIPS IN A CONTINUOUS FURNACE

(71) Applicant: FIVES STEIN, Maisons-Alfort (FR)

(72) Inventors: Pascal Thevenet, Maisons-Alfort (FR); Loïc Krotoff, Maisons-Alfort (FR); Stéphane Mehrain, Maisons-Alfort (FR)

(73) Assignee: FIVES STEIN

( * ) Notice: Subject to any disclaimer, the term of this patent is extended or adjusted under 35 U.S.C. 154(b) by 389 days.

(21) Appl. No.: 16/067,236

(22) PCT Filed: Dec. 19, 2016

(86) PCT No.: PCT/EP2016/081730
§ 371 (c)(1),
(2) Date: Jun. 29, 2018

(87) PCT Pub. No.: WO2017/114682
PCT Pub. Date: Jul. 6, 2017

(65) Prior Publication Data

US 2019/0010575 A1 Jan. 10, 2019

(30) Foreign Application Priority Data

Dec. 30, 2015 (FR) ..... 1563467

(51) Int. Cl.
*C21D 9/56* (2006.01)
*F27D 7/00* (2006.01)
(Continued)

(52) U.S. Cl.
CPC ..... *C21D 9/561* (2013.01); *F27D 7/00* (2013.01); *F27D 9/00* (2013.01); *C21D 1/767* (2013.01);
(Continued)

(58) Field of Classification Search
CPC ..... C21D 1/56; C21D 1/561; C21D 1/767; C21D 9/56; C21D 9/561; F27D 2019/0003; F27D 2019/0031; F27D 7/00; F27D 9/00
(Continued)

(56) References Cited

U.S. PATENT DOCUMENTS 3,887,349 A * 6/1975 Akashi ..... C03C 17/002 65/161
5,885,382 A * 3/1999 Sakurai ..... C21D 1/613 148/661
(Continued)

FOREIGN PATENT DOCUMENTS

EP 2100673 9/2009
FR 2920439 3/2009
(Continued)

OTHER PUBLICATIONS

Corresponding International Search Report for PCT/EP2016/081730 dated Mar. 17, 2017.

*Primary Examiner* — Jessee R Roe
*Assistant Examiner* — Michael Aboagye
(74) *Attorney, Agent, or Firm* — The Belles Group, P.C.

(57) ABSTRACT

The invention relates to a chamber (1) for the controlled oxidation of metal strips in a furnace for annealing a continuous production line of strips which are hot-coated, for example by galvanisation, the oxidation chamber allowing the oxidation of the metal strips by means of an oxidising gas injected on at least one of the faces of a strip (15), the oxidation chamber comprising oxidation portions (17) extending over the width and/or length thereof, each portion comprising at least one blow opening (4) and at least one suction opening (5) between which an oxidising gas circulates, each portion being controllable in a different way so as
(Continued)

Figure 1:
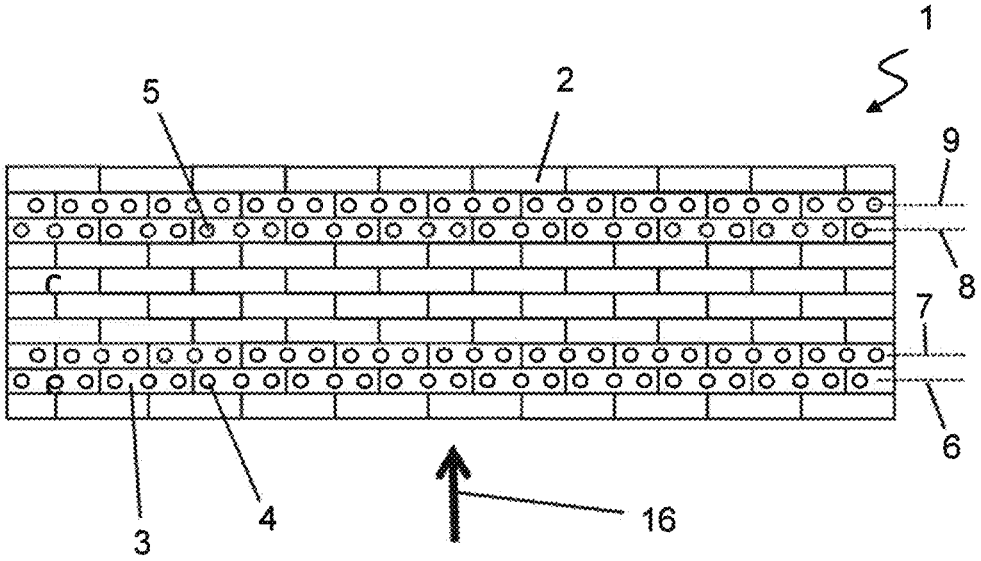

to adjust the oxidation induced on the strip over the width and length of the oxidation chamber.

15 Claims, 5 Drawing Sheets

(51) Int. Cl.
*F27D 9/00* (2006.01)
*C21D 1/767* (2006.01)
*F27D 19/00* (2006.01)

(52) U.S. Cl.
CPC ..... *C21D 9/56* (2013.01); *F27D 2019/0003* (2013.01); *F27D 2019/0031* (2013.01)

(58) Field of Classification Search
USPC ..... 148/661; 266/110, 111
See application file for complete search history.

(56) References Cited

U.S. PATENT DOCUMENTS

| | | | | |
|---|---|---|---|---|
| 6,241,515 | B1 * | 6/2001 | Nayar | C21D 9/0006 266/171 |
| 8,591,675 | B2 | 11/2013 | Muller et al. | |
| 8,609,192 | B2 * | 12/2013 | Borrel | C21D 9/52 427/248.1 |
| 9,551,046 | B2 * | 1/2017 | Blumenau | F27D 99/0075 |
| 2004/0177903 | A1 * | 9/2004 | Francois | C23C 2/003 148/533 |
| 2010/0173072 | A1 * | 7/2010 | Borrel | C21D 9/561 427/248.1 |

FOREIGN PATENT DOCUMENTS

| | | |
|---|---|---|
| JP | S63149323 | 6/1988 |
| JP | 2003342645 | 12/2003 |
| WO | 2011072883 | 6/2011 |

* cited by examiner

DEVICE AND METHOD FOR CARRYING OUT CONTROLLED OXIDATION OF METAL STRIPS IN A CONTINUOUS FURNACE

PRIORITY

Priority is claimed as a national stage application, under 35 U.S.C. § 371, to international patent application No. PCT/EP2016/081730, filed Dec. 19, 2016, which claims priority to French patent application FR1563467, filed Dec. 30, 2015. The disclosures of the aforementioned priority applications are incorporated herein by reference in their entirety.

APPLICATION DOMAIN

The invention concerns a device and a method for carrying out controlled oxidation of metal strips, in particular steel, in continuous annealing line furnaces whose purpose is the production of hot-dipped sheet metal, for example by galvanizing (coating of zinc, zinc and aluminum, zinc and magnesium, or any other combination). It functions in the context of a selective oxidation carried out in a controlled atmosphere annealing furnace, or total oxidation in an oxidizing annealing furnace, usually with direct flame.

Technical Problem to which the Invention Provides a Solution

In a selective or total oxidation section, heterogeneity, across the width and length of the strip, of oxygen content in the oxidizing gas, its temperature and its flow velocity at the surface of the strip creates different oxidation on the strip. This is particularly the case in oxidation areas where the extraction of the oxidizing gas from the oxidation chamber is not controlled.

STATE OF THE ART

The production of certain types of steel poses a problem of adhesion of the coating for grades containing high levels of alloys elements such as manganese, silicon or aluminum, by creating oxides on the surface of the strip, inhibiting the wettability of the substrate.

Several processes exist to improve this wettability, including:

Creation of an iron oxide on the surface, called total oxidation, in a direct flame oxidizing furnace, forming a barrier to the rise of these elements and their oxidation on the surface, followed by a reduction of these oxides before coating the strip.

Deep oxidation of these elements preventing them from rising to the surface, in a controlled atmosphere furnace, by oxygen injection or water, called selective oxidation, followed by a reduction of the oxides present on the surface before coating the strip.

Document EP2458O22 describes the oxidation of strips by injection on the strip, through a nozzle system, of a mixture of air and nitrogen, or a mixture of oxygen and nitrogen in a radiant tube or direct-fired furnace working in a substantially non-oxidizing manner. The nozzle system is designed to distribute the oxidizing gas homogeneously on the width of the strip. It does not make it possible to vary the distribution of the oxidizing gas to correct an oxidation heterogeneity on the strip present on system entry by achieving greater oxidation where oxidation is lower upstream in the system.

Commonly used oxidation chambers have an extraction system for the oxidizing gas at each end. No means is placed inside the chambers to locally extract the oxidizing gas and thus limit the interference between the injected gas and the gas which has been in contact with the strip.

The invention makes it possible to overcome these problems by controlling the oxidation of the strip in its longitudinal and transverse directions. It can also be used in direct fired furnaces preferentially oxidizing or preferentially non-oxidizing or in controlled atmosphere furnaces.

DESCRIPTION OF THE INVENTION

The invention consists of producing an injection of air or flue gas, or an air/flue gas mixture, on the strip in a so-called "controlled oxidation" chamber, wherein the strip is at a suitable temperature to undergo the required oxidation. The controlled oxidation chamber has means to control flow, temperature, and injection kinetics of the injected gas on the strip as required and to ensure evacuation of the chamber after its reaction with the strip.

This solution can be applied over the entire width of the strip or only on a transverse or longitudinal part of the strip requiring additional oxidation.

Because of its 21% oxygen content, the air injection makes it possible to obtain a high oxygen level at a lower cost, compared to current state-of-the-art techniques. This minimizes the dimensions of the injection circuits and achieves greater oxidation reactivity.

The injection of flue gas, or an air/flue gas mixture, makes it possible to achieve a controlled oxygen content of less than 21%, which reduces the rate of oxidation compared to air injection but gives a finer adjustment and therefore greater oxidation accuracy than using clean air.

The choice of one solution or the other can be defined according to the need and obviously represents a savings with respect to the use of a mixture of oxygen or nitrogen taken separately.

The injection of the oxidizing gas at a controlled speed makes it possible to improve the process because it is accepted that a minimum critical speed of the oxidizing gas at sheet surface greatly increases the rate of oxidation.

Advantageously, the invention is set up to work downstream of a first section in which a "coarse" oxidation takes place to substantially obtain the required oxide thickness. Coarse oxidation means oxidation without fine control of it over the width of the strip. So, the second section downstream incorporating the invention makes it possible to finely adjust the oxide thickness on the width of the strip so that it is homogeneous. The first section of coarse oxidation can be a selective oxidation section in a controlled atmosphere annealing furnace, for example in an RTF (Radiant Tube Furnace). The controlled oxidation chamber, according to the invention, is placed downstream, for example between a heating section and a soaking section, or in a connecting tunnel between two sections of the continuous line, for example in the tunnel connecting the RTF and the cooling section of the strip. The first coarse oxidation section may also be a direct flame heating section, for example a NOF (Non-Oxidizing Furnace) or DFF (Direct Firing Furnace) section. The oxidation chamber controlled according to the invention is, for example, placed at the outlet of the NOF section or DFF section, in the moving direction of the strip, or in the connection tunnel between the NOF or DFF section and the radiant tube furnace, in the radiant tube furnace or downstream of it.

The device according to the invention is comprised of a transverse multi-part blowing system over the width and length of the strip, independently controlling the required oxide value over the strip's width. A suction system symmetrical to blowing system allows the recovery of the injected gas after its reaction with the surface of the strip, limiting the interference between the gas to be injected and the gas that has been in contact with the strip.

The distance between the injection system and the strip is determined according to the geometry and the distribution of the blowing ports and the kinematics of the jets so as to cover the surface of the strip with little overlap of the jets on it. The injection system and the suction system can be placed at the same distance from the strip, or can be shifted, the suction being for example placed at a greater distance from the strip.

The suction and blowing parts of the area are controlled simultaneously which allows the injected gas flow to evacuate after a staying time equivalent to the defined distance and not to diffuse laterally to other areas of the strip, and thus cause unwanted oxidation on other areas of the strip.

The temperature level of the oxidizing gas at the outlet of the injection system is advantageously close to that of the strip in order to limit thermal stresses in the strip that could cause its deformation.

A hot gas also increases the reactivity of the oxidation compared to a cold gas.

Advantageously, the transverse and longitudinal distribution of the oxidation of the strip upstream of the controlled oxidation chamber according to the invention is determined so as to identify the places where the controlled oxidation must take place and how much. This surface analysis of the strip upstream of the device according to the invention can be produced by sensors measuring the thickness of the oxidation over the width of the strip or by an analysis of images of the strip.

The controlled oxidation chamber of metal strips in an annealing furnace of a continuous production line of hot-coated strips, for example by galvanizing, the oxidation chamber allowing the oxidation of the metal strips by means of an oxidizing gas injected on at least one of the sides of a strip, is characterized in that it comprises portions of an oxidation zone extending over its width and/or length, each portion comprising at least one blowing port and at least one suction port between which an oxidizing gas circulates, each portion being controllable separately to adjust the oxidation on the strip over the width and length of the oxidation chamber.

The oxidizing gas can be injected onto the strip in a direction substantially perpendicular to the strip by means of blowing ports and then the oxidizing gas flows in the chamber to suction ports in a direction substantially parallel to the moving direction of the strip or in a direction having a component perpendicular to the moving direction of the strip. Suction ports placed on the sides of a suction portion with respect to the moving direction of the strip, in addition to one or more suction ports placed at the end of the suction portion in the moving direction of the strip that produce a flow of the oxidizing gas in the chamber in a direction having a component perpendicular to the moving direction of the strip. The combination of these suction ports allows precise definition of the periphery of each oxidation portion.

The controlled oxidation chamber may be placed downstream, in the direction of travel of the strip, of a section in which the strip undergoes a first oxidation.

The oxidizing gas used can be air, flue gas, or a mixture of air and flue gas. The flue gas advantageously comes from at least one burner placed close to the controlled oxidation chamber, for example burners with open flame of a NOF section or radiant tube burners of an RTF furnace. The flue gas collected near the controlled oxidation chamber, for example in a flue gas exhaust plenum, is thus injected into the controlled oxidation chamber.

Advantageously, the controlled oxidation chamber comprises at least one oxidation sensor located upstream of the oxidation portion and downstream of the oxidation portion, the information from the oxidation sensor being integrated into the calculation of the flow of oxidizing gas leaving the blowing port of the oxidation portion.

The invention also concerns a controlled oxidation process of metal strips implemented in a controlled oxidation chamber mentioned above, by means of an oxidizing gas injected on at least one of the sides of the strip, said oxidizing gas being air or combustion flue gas, or a mixture of air and combustion flue gas.

Advantageously, the characteristics of the oxidizing gas and/or the kinetics of injection and suction of the oxidizing gas in the oxidation portions are controlled separately to adjust the oxidation on the strip in the width and length of the oxidation chamber.

More advantageously, the dimensions of an oxidation portion are controlled by the choice of the blowing ports and the suction ports in use in said portion. For this purpose, several series of blowing ports and several series of suction ports are provided. We then make a choice among these series of ports depending on the required distance between blowing zone and the suction zone, i.e. according to the required oxidation.

The staying time of the oxidizing gas in the controlled oxidation chamber can be adjusted by the portion along the length of said portion in the moving direction of the strip.

In what follows, the invention is explained in detail based on examples of the process with reference to FIGS. 1 to 7 of the drawings.

Figure 2:
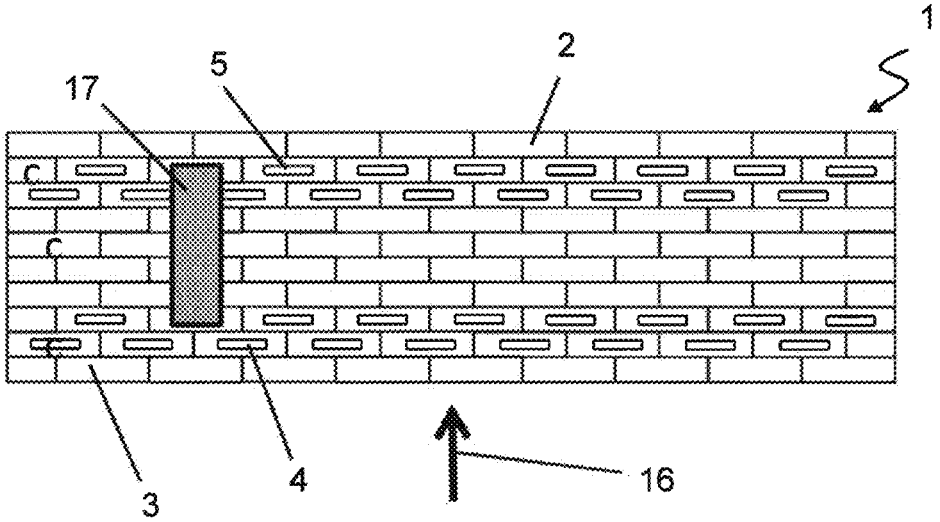
Figure 3:
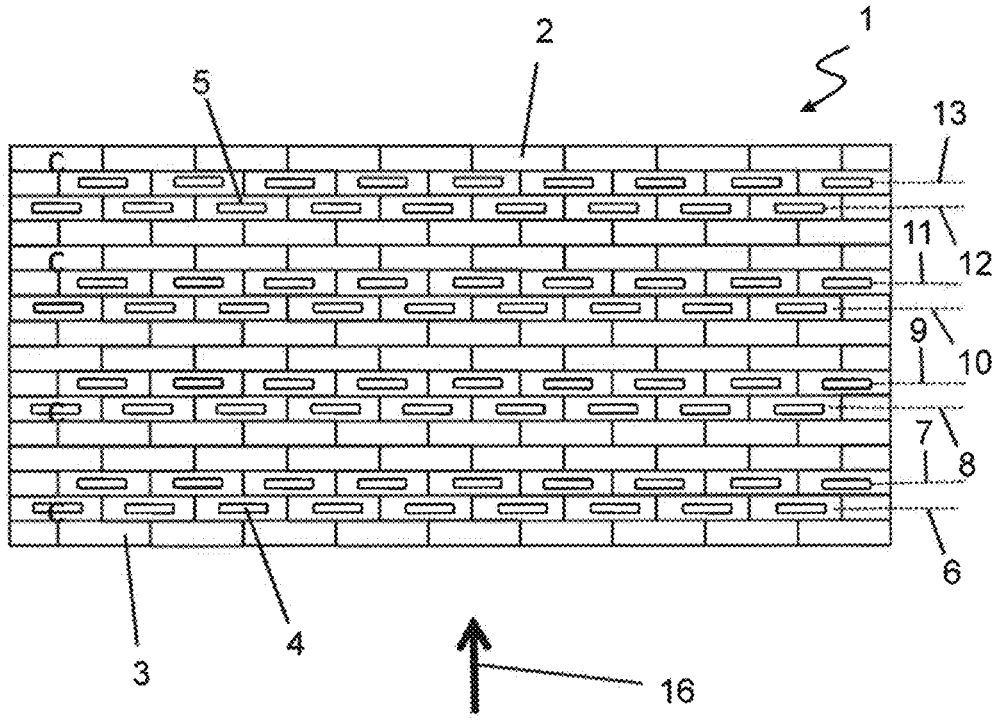
Figure 4:
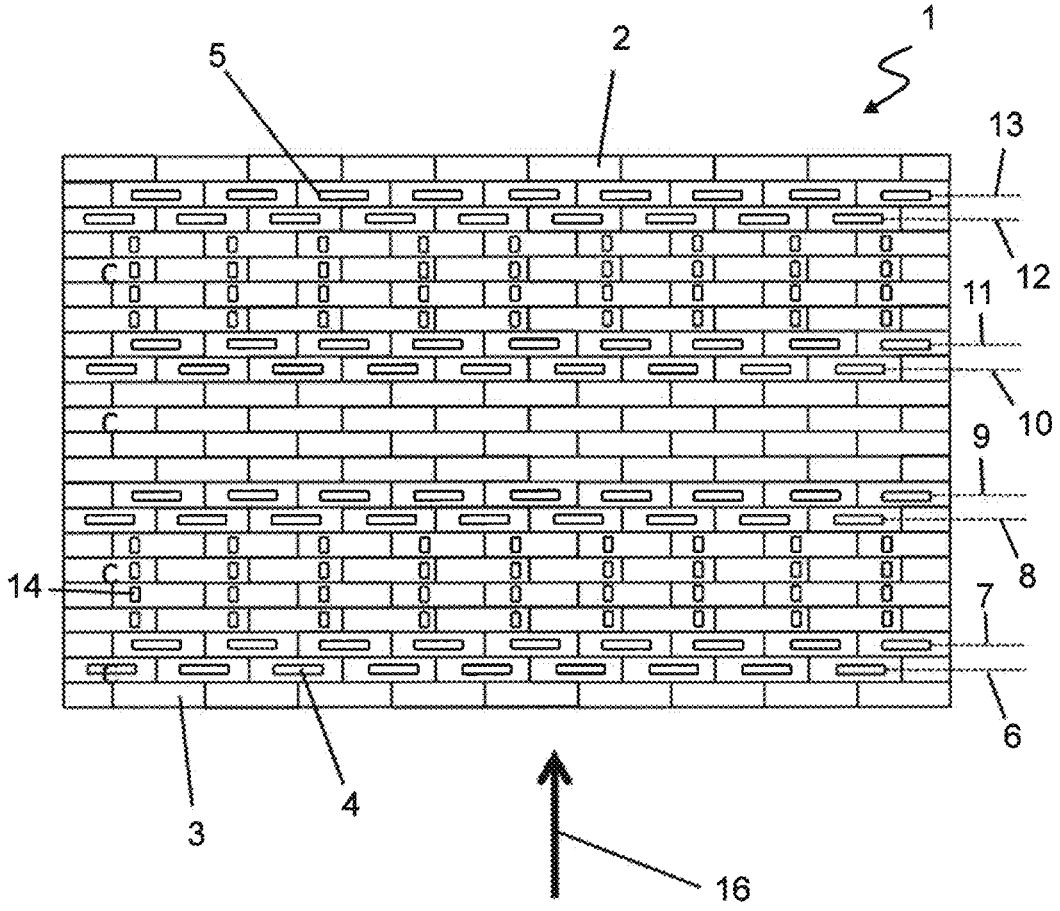
Figure 5:
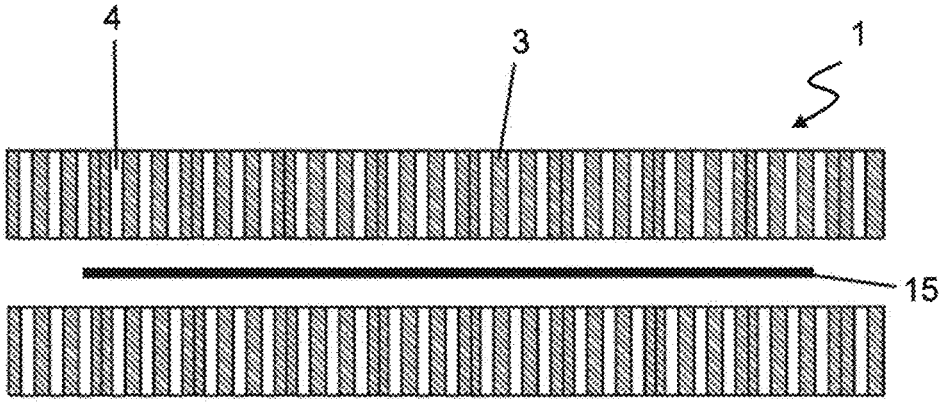
Figure 6:
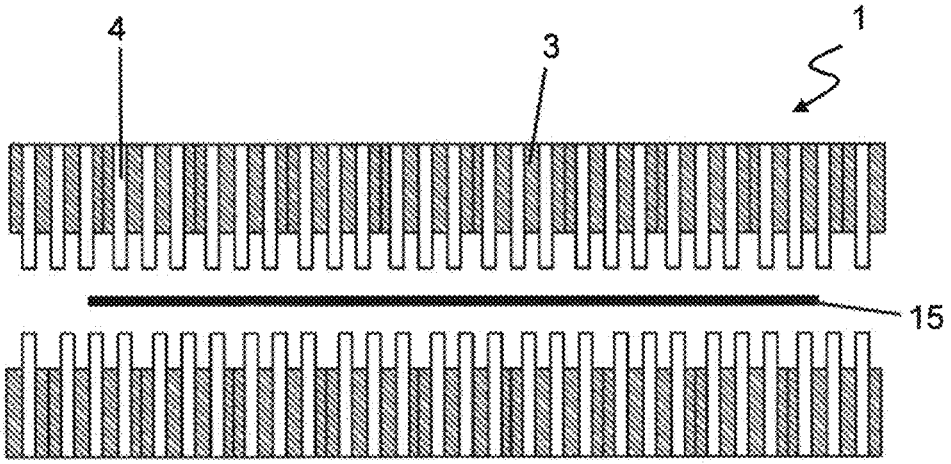
Figure 7:
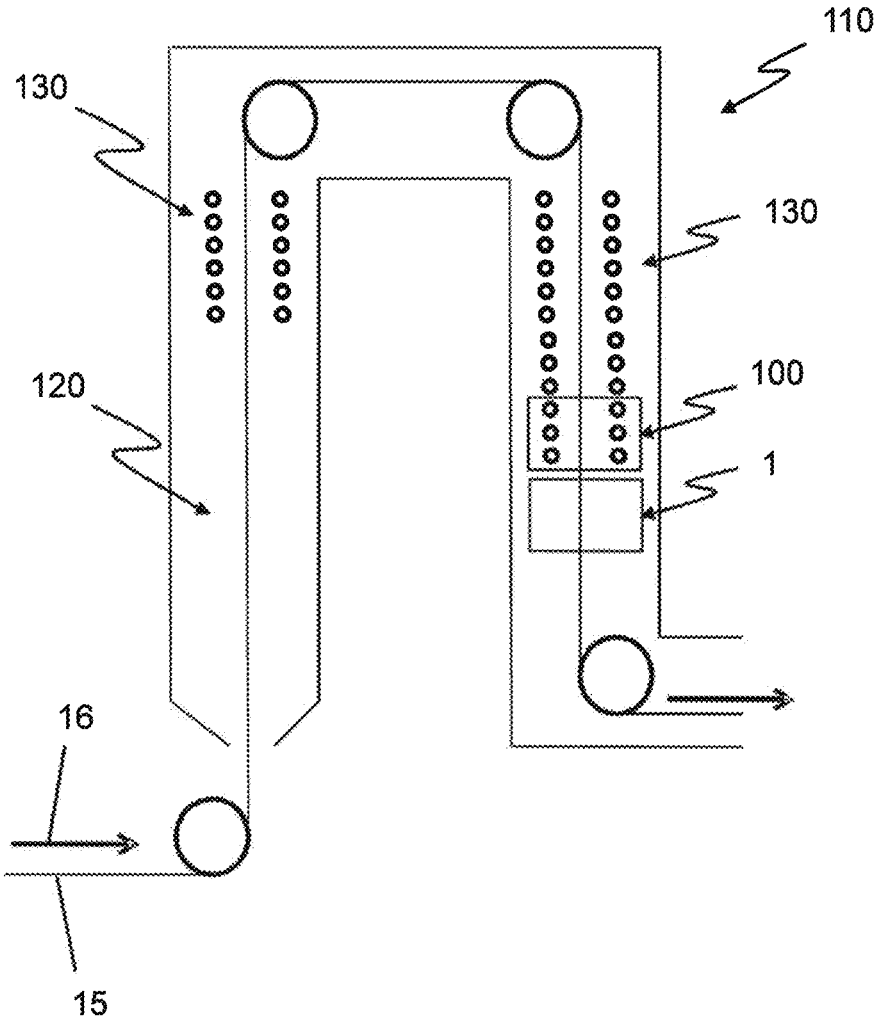

FIG. 1 is a partial schematic representation of an oxidation chamber according to an example embodiment of the invention, as seen from one side of the strip, comprising circular blowing and suction ports, distributed over a blowing zone and a suction zone, FIG. 2 is a partial schematic representation of an oxidation chamber according to an example embodiment of the invention like that of FIG. 1, as viewed from one side of the strip, the blowing and suction ports being rectangular, FIG. 3 is a partial schematic representation of an oxidation chamber according to an example embodiment of the invention like that of FIG. 2, as seen from one side of the strip, the wall of the oxidation chamber comprising four series of ports instead of two, FIG. 4 is a partial schematic representation of an oxidation chamber according to an example embodiment of the invention like that of FIG. 3, as seen from one side of the strip, the wall of the oxidation chamber also comprising suction ports placed transversely, FIG. 5 is a partial schematic representation of an oxidation chamber in cross-section according to an example embodiment of the invention in which the blowing ports do not project beyond the internal walls of the chamber;

FIG. 6 is a partial schematic representation of an oxidation chamber in cross-section according to an example embodiment of the invention in which the blowing ports protrude from the internal walls of the chamber, and FIG. 7 is a partial schematic representation of a continuous line comprising an oxidation chamber according to an example embodiment of the invention.

Throughout the following description of various embodiments of the invention, the relative terms such as "front", "back", "upstream" and "downstream" are to be interpreted in view of the strip's moving direction as well as terms such as "above", "below" are to be interpreted in view of the position of the different elements in the figures.

FIGS. 1 to 4 present in schematic views examples of oxidation chamber architectures according to the invention in which the strip travels in the direction indicated by the arrow 16, in an oxidizing or non-oxidizing furnace zone. These figures show schematically in front view an example of a wall 2 of a controlled oxidation chamber 1 according to the invention, as seen from one side of the strip. The walls of the oxidation chamber here consist of elementary modules 3 juxtaposed, of rectangular shape. For example, it can be a brick made from refractory material. However, this example embodiment is just an illustration; other embodiments may be used. For example, the walls of the oxidation chamber may be in one module. They can be covered with refractory fiber, and possibly covered with a stainless-steel plate.

As can be seen in these figures, certain elementary modules 3 comprise circular or rectangular ports 4, 5 through which the gas is injected onto the strip or is discharged from the oxidation chamber. The number of injection ports 4 per elementary module and the unit section of these ports are chosen to cover the entire width of the strip with unit gas jets whose shape and kinematics allow to cover a unitary band surface with a speed adapted to ensure the oxidation of the strip.

In these examples, suction ports 5 are placed above blowing ports 4, but this example is not restrictive, the suction ports can be placed below the injection ports. In these examples, if the strip circulates as represented from bottom to top, the flow of the injected gas is therefore in the direction of flow of the strip. If the strip flows from top to bottom, the flow of the injected gas is therefore in the opposite direction of the flow of the strip. Regarding the use of these references at high and low positions, we thought these figures illustrate a vertical chamber. Obviously, it could also be a horizontal chamber, with a horizontal direction of travel of the strip, or an inclined chamber, for which the position of the ports would then be defined more generally according to the moving direction of the strip.

In FIG. 1, we can see an example embodiment in which the blowing ports 4 are located on two successive rows of unitary modules 3. The blowing ports are thus aligned on two lines 6, 7 parallel to the width of the strip. In this example, we have three ports per unit module. The position of the ports is shifted to the second row 7 with respect to the first row 6, so as to obtain a greater coverage of the strip surface over its width. The suction ports 5 have a similar distribution and are distributed in two rows 8 and 9. The distribution of the suction ports 5 is symmetrical to that of the blowing ports 4 along an axis of transverse symmetry passing half way between the blowing ports 4 and suction ports 5. The distance between the blowing zone and the suction zone, in the moving direction of the strip, depends on the maximum travel speed of the strip and the kinematics of the oxidizing gas blown on the strip. Here it corresponds to three rows of unitary modules.

The number of blowing ports 4 and suction ports 5 in operation and their location are adjusted according to the locations on the surface of the strip that require additional oxidation. The suction ports 5 in operation are naturally aligned with the blowing ports 4, in the moving direction of the strip.

The flow rate of the oxidizing gas may be adjusted by line 6, 7 of blowing ports, by set of blowing ports, or individually by blowing port 4, so as to adjust for each port 4 or set of ports the kinematics of the oxidant gas jets and effect on the strip.

Moreover, when the oxidizing gas is a mixture of air and flue gas, it is also possible to vary the concentration of oxygen in the oxidizing gas through the blowing port, or through a set of blowing ports, by adjusting the proportions of air and flue gas, and thus adjust the oxidizing power of the gas jets.

We see that more resources can be used independently or in combination to fine-tune the oxidation of the strip at each point in the process.

In FIG. 2, we can see a schematic representation of an example embodiment like that shown in FIG. 1 but with rectangular blowing and suction ports. A unitary portion 17 delimited by a blowing port and a suction port is shown in this figure.

FIG. 3 schematically represents, by way of example, the architecture of an oxidation chamber according to the invention having 8 lines 6 to 13 of ports per strip face. This oxidation chamber longer than those of FIGS. 1 and 2 is especially adapted for high travel speeds of the strip. Furthermore, for the same strip travel speed as that of the chambers shown in FIGS. 1 and 2, the longer length of the oxidation chamber makes it possible to carry out the oxidation with a slower kinematics, which may be advantageous for certain types of steel.

For example, this chamber can thus have two successive oxidation zones by blowing/suction, the lines of ports 6, 7, 10 and 11 ensuring blowing and lines 8, 9, 12 and 13 suction. It is for example possible to dedicate each to a different type of gas, or to blow the same gas with two different injection kinematics.

This chamber can also be operated using only the lines of ports 6 and 7 for blowing the oxidizing gas and lines 8 to 13 for suction. Depending on the required exchange length between the oxidizing gas and the strip, the suction ports used will be those of lines 8 and 9, those of lines 10 and 11 or those of lines 12 and 13, the lines 8 and 9 leading to the shortest exchange length and lines 12 and 13 to the longest exchange length.

FIG. 4 schematically represents, by way of example, the architecture of an oxidation chamber according to the invention in the same principle as that of FIG. 3 but advantageously having transverse suction arranged successively according to the width of the furnace. The presence of these transversal suction ports 14 makes it possible to delimit precisely on the width of the strip, and on the length of the oxidation chamber, zones in which the oxidation can be controlled separately.

The device according to the invention can thus be composed of a longitudinal blowing system in several independently controlled parts and a suction system arranged alternately to the blowing and arranged at an advantageous distance to control the required oxide value on the strip. The suction and blowing parts of the zone in question are controlled simultaneously, which allows the injected air flow to be discharged after an equivalent residence time at the set distance and not to be spread laterally to other areas of the strip, and thus cause unwanted oxidation on other areas of the strip.

FIG. 5 schematically represents a sectional view of an oxidation chamber 1 at the level of blowing ports 4, according to one embodiment of the invention. In this example, the blowing ports do not protrude from the unit modules 3 in the direction of the strip 15.

FIG. 6 schematically represents a cross-sectional view of an oxidation chamber 1 at the level of blowing ports 4, according to another example embodiment of the invention in which the blowing ports protrude from the unit modules 3 in the direction of the strip 15.

In the two example embodiments in FIGS. 5 and 6, the suction ports are not shown. They may not protrude from the unit modules 3 in the direction of strip 15 or protrude from said modules. In an oxidation chamber according to the invention, the blowing and suction ports may not protrude from the unit modules 3 towards the strip 15, the blowing ports may not protrude while the suction ports protrude, and the blowing ports may protrude while the suction ports do not protrude.

The distance between the strip and the end of the blowing and suction ports is related to the flow rate and the kinematics of the oxidizing gas jets.

The inventor states that the minimum air injection rate in the oxidation zone is very low (for example 10 $Nm^3/h$ of air for a flow of oxidizing gas over a length of one meter, measured between blowing and sucking and/or length, in the longitudinal direction of the strip'smovement, corresponding to the required oxidation portion, said length giving an oxide thickness of 70 nm over a 1500 mm wide strip traveling at 100 m/min at a temperature of 650° C.), the control of the oxidation can take place advantageously by opening/closing one or more oxidation zones (blowing/suction) and thus varying the overall flow rate by varying the strip's residence time under oxidizing gas and thus varying the thickness of oxide. If only some of the zones are used in oxidation, and in order not to diffuse the oxidizing gas in other zones, it can be replaced by a nitrogen flow to create a barrier with the oxidation zone.

This operation can be performed over the entire width of the strip or only a part, thus giving great flexibility in the management of the atmosphere in contact with the strip while keeping the critical speeds of injection on the strip in the required oxidation zone and isolating the other zones by injection of a neutral gas such as nitrogen for example. This operating mode makes it possible to dispense with the travel speed of the strip in the control of the oxide thickness.

According to an advantageous example embodiment, the device according to the invention is placed downstream of an oxidation section without precise control of oxidation on the width of the strip. This allows, for example, to achieve most of the targeted oxide layer quickly, that is to say over a limited furnace length. The device according to the invention then makes it possible to carry out additional oxidation locally, for example to obtain a homogeneous oxide thickness over the width of the strip or to reinforce it locally.

The oxidation section without the exact oxidation of the strip's width also make it possible to produce a layer whose oxides will have a morphology or a given composition different from the surface layer, which will then be produced by the device according to the invention.

DETAILED DESCRIPTION OF AN EMBODIMENT OF THE INVENTION

According to an example embodiment of the invention, represented in FIG. 7, the oxidation section 100 without precise control of the oxidation over the width of the strip is a portion of a furnace 110 preheating the strip by direct flame. From the strip input, this furnace comprises a zone 120 for preheating the strip by exhausting the flue gas followed by a heating zone 130 equipped with direct flame burners. In this example embodiment, in the moving direction of the strip, the first 15 pairs of burners (over 13 m of furnace length) operate under stoichiometry so as to avoid oxidizing the strip. The last 3 pairs of burners (over 4.2 m of furnace length) delimit the section 100 in which the burners operate with a large excess of air to obtain a significant oxidation of the strip. The device 1 according to the invention placed downstream of this oxidizing zone then makes it possible to fine-tune the oxidation over the width of the strip.

The 1500 mm wide strip circulates with a nominal speed of 100 m/min. The chamber 1 has a length of 475 mm in the moving direction of the strip. The blowing zone has 55 ports arranged on two transverse lines 80 mm apart. The suction zone has 55 ports arranged on two transverse lines 80 mm apart. The distance between the nearest blowing and suction lines is 315 mm. The blowing ports are placed 100 mm from the strip every 58 mm depending on the width of the strip. Their injection diameter is 25 mm. The suction ports are placed 100 mm from the strip every 58 mm according to the strip width. Their suction diameter is 25 mm.

The oxidizing gas is air. It is injected on the strip at a nominal speed of 3 m/s. The injection speed is modulated by injector, or injector assembly, between 0 and 5 m/s according to the amount of the oxidation required on the surface of the affected strip. The strip is at 650° C. when it enters the oxidation chamber. The oxidizing gas is injected at a temperature of 650° C.

The invention claimed is:

1. An oxidation chamber for controlled oxidation of metal strips in an annealing furnace of a continuous production line for hot-coated strips, the oxidation chamber comprising oxidizing portions extending over a width and/or length of the oxidation chamber, each oxidizing portion comprising at least one blowing port through which an oxidizing gas is injected into the oxidation chamber for contact with the metal strip and at least one suction port for removing the oxidizing gas from the oxidation chamber after the oxidizing gas has contacted the metal strip, the oxidizing gas circulating within the oxidation chamber between the at least one blowing port and the at least one suction port, and wherein the at least one blowing port and the at least one suction port of each of the oxidizing portions are configured to be controlled separately to adjust an oxidation induced on the metal strip over the width and length of the oxidation chamber.

2. An oxidation chamber according to claim 1, wherein the oxidizing gas is injected onto the metal strip in a direction substantially perpendicular to the metal strip by means of the blowing ports and the oxidizing gas circulates in the chamber to the suction ports in a direction substantially parallel to a moving direction of the metal strip.

3. An oxidation chamber according to claim 1, wherein the oxidation chamber is placed downstream of a section in which the metal strip undergoes a first oxidation in a moving direction of the metal strip.

4. An oxidation chamber according to claim 1, wherein the oxidizing gas is air.

5. An oxidation chamber according to claim 1, wherein the oxidizing gas is a mixture of air and flue gas.

6. An oxidation chamber according to claim 1, further comprising at least one oxidation sensor situated upstream and/or downstream of the oxidizing portion, information from the oxidation sensor being integrated into a calculation of the oxidizing gas flow leaving the blowing port of the oxidizing portion.

7. The oxidation chamber according to claim 1 wherein for each of the oxidizing portions, the at least one blower port and the at least one suction port are configured to be controlled simultaneously.

8. The oxidation chamber according to claim 1 wherein the oxidation chamber is defined by at least one wall, and wherein the at least one blowing port and the at least one suction port comprise openings in the wall.

9. The oxidation chamber according to claim 1 wherein the oxidation chamber comprises a plurality of the oxidizing portions arranged in a side-by-side manner along the width of the oxidation chamber.

10. The oxidation chamber according to claim 1 further comprising a plurality of the blowing ports arranged in at least one row along the width of the oxidation chamber and a plurality of the suction ports arranged in at least one row along the width of the oxidation chamber.

11. An oxidation chamber for controlled oxidation of metal strips in an annealing furnace of a continuous production line for hot-coated strips, the oxidation chamber comprising:

at least one wall;

a plurality of blower ports formed as openings in the at least one wall for blowing an oxidizing gas into the oxidation chamber, the plurality of blower ports arranged in at least a first row along the at least one wall;

a plurality of suction ports formed as openings in the at least one wall for evacuating the oxidizing gas from the oxidation chamber, the plurality of suction ports arranged in at least a second row along the at least one wall;

a plurality of oxidation portions, each of the oxidation portions comprising at least one of the plurality of blower ports and at least one of the plurality of suction ports; and wherein the at least one of the plurality of blower ports and the at least one of the plurality of suction ports of each of the oxidation portions are configured to be controlled separately to adjust an oxidation induced on a metal strip moving through the combustion chamber.

12. The oxidation chamber according to claim 11 wherein the plurality of blower ports are arranged in the first row and a third row, the plurality of blower ports in the third row being offset from the plurality of blower ports in the first row, and wherein the plurality of suction sports are arranged in the second row and a fourth row, the plurality of suction ports in the fourth row being offset from the plurality of suction ports in the second row.

13. The oxidation chamber according to claim 12 wherein the first and third rows are adjacent to one another in a direction of movement of the metal strip through the oxidation chamber and wherein the second and fourth rows are adjacent to one another in the direction of movement of the metal strip.

14. The oxidation chamber according to claim 11 wherein the oxidation chamber has a width and a length, the metal strip being configured to move through the oxidation chamber in a direction of the length of the oxidation chamber, and wherein each of the first and second rows extends in a direction along the width of the oxidation chamber.

15. The oxidation chamber according to claim 11 wherein for each of the oxidation portions, each of the blower ports is aligned with one of the suction ports in a direction of movement of the metal strip through the oxidation chamber.

* * * * *